US005570482A

United States Patent [19]

Asakawa

[11] Patent Number: 5,570,482

[45] Date of Patent: Nov. 5, 1996

[54] SUPPORTER FOR A HUMAN BODY AND BED EQUIPMENT USING THE SAME

[76] Inventor: Yoshio Asakawa, 287 Tsubuku Honmachi, Kurume-shi, Fukuoka-ken, Japan

[21] Appl. No.: 191,595

[22] Filed: Feb. 4, 1994

[30] Foreign Application Priority Data

Feb. 4, 1993 [JP] Japan ..... 5-040520
Jun. 30, 1993 [JP] Japan ..... 5-189102

[51] Int. Cl.[6] ..... A61G 7/10

[52] U.S. Cl. ..... 5/81.1 C; 5/83.1; 5/89.1

[58] Field of Search ..... 5/81.1, 83.1, 88.1, 5/89.1, 84.1

[56] References Cited

U.S. PATENT DOCUMENTS 1,709,153 4/1929 Pownall ..... 5/83.1
3,978,531 9/1976 Ilon ..... 5/81.1
4,627,119 12/1986 Hachey et al. ..... 5/83.1
5,072,840 12/1991 Asakawa et al. ..... 212/205
5,161,267 11/1992 Smith ..... 5/81.1 X
5,239,713 8/1993 Toivio et al. ..... 5/89.1 X

*Primary Examiner*—Michael F. Trettel
*Attorney, Agent, or Firm*—Christopher R. Pastel; Thomas R. Morrison; George J. Brandt, Jr.

[57] ABSTRACT

A bed equipment using a supporter for a human body, such as an incapacitated patient, is used to raise the patient from a surface, such as a bed, so that a hammock may be spread on the bed and the patient lowered onto the hammock. The supporter is formed by inserting an arm and a belt into a sleeve, and fits between the patient and the bed without causing the patient pain. Preferably, the belt has holes in either end so that suspending strings may be engaged by hooks. The suspending strings are raised or lowered by preferably independent motors so that the patient can be raised or lowered comfortably. The suspending strings may be moved relative to each another or fixed relative to each other. Once the patient is on the hammock, the hooks are removed from the supporter and attached to the hammock. Various rails and motors allow the patient on the hammock to be moved horizontally from the bed over a bathtub or toilet, and then lowered and raised accordingly.

12 Claims, 16 Drawing Sheets

FIG. 2(a)
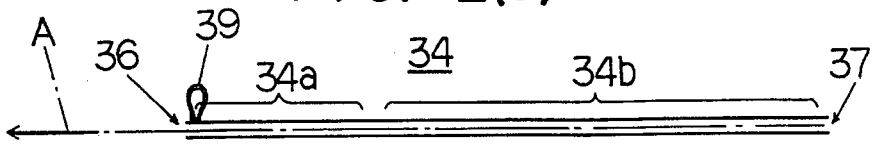
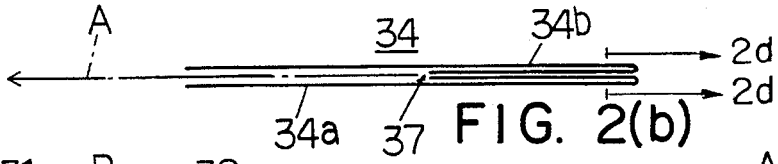
FIG. 2(b)
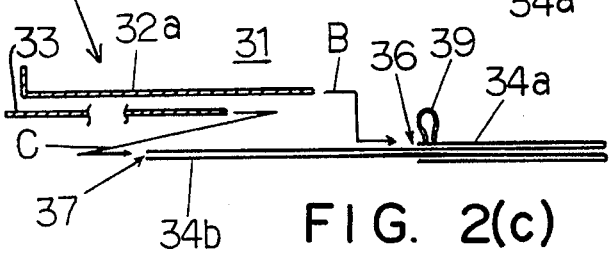
FIG. 2(c)
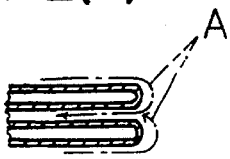
FIG. 2(d)

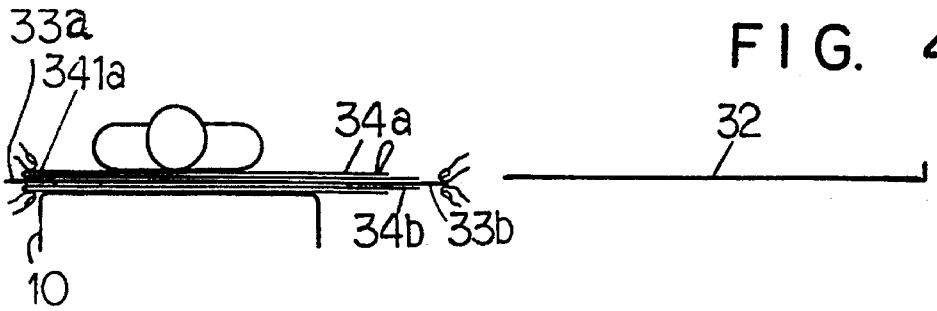
FIG. 4(a)
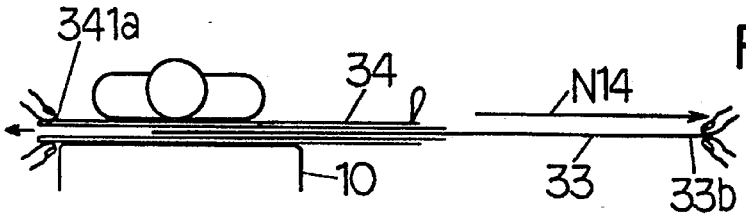
FIG. 4(b)
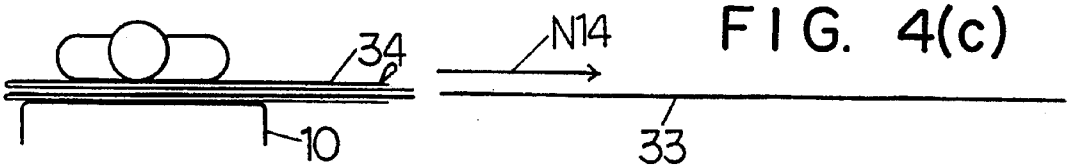
FIG. 4(c)
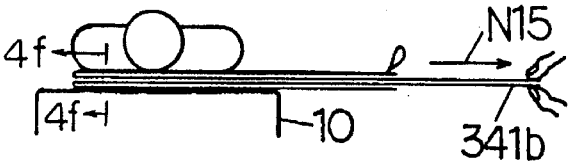
FIG. 4(d)
FIG. 4(e)
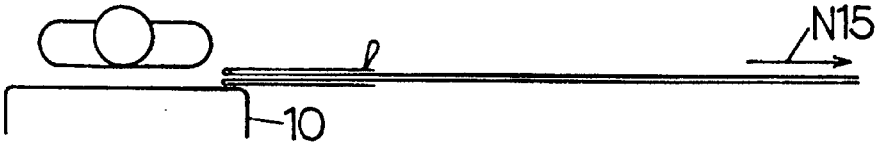
FIG. 4(f)
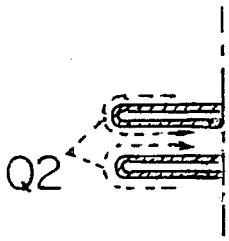

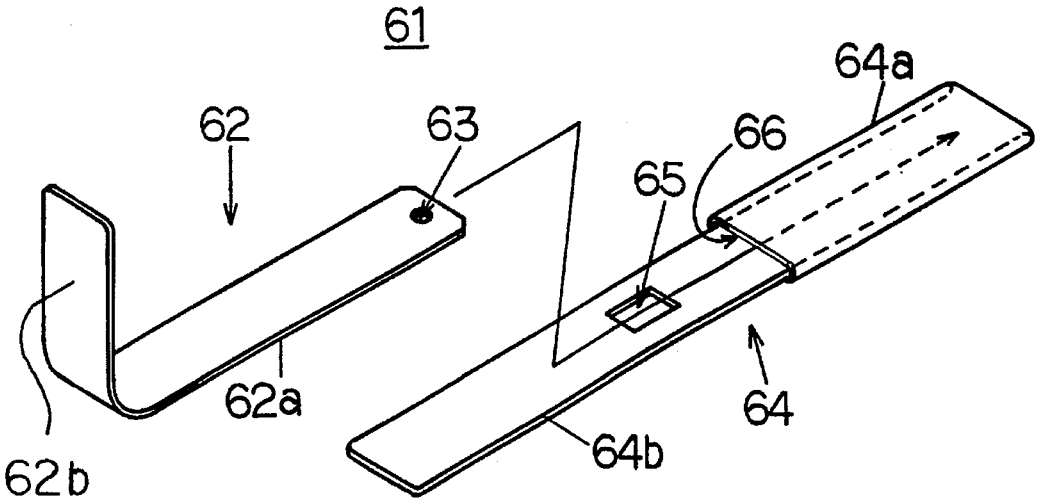
FIG. 12
FIG. 13(a)
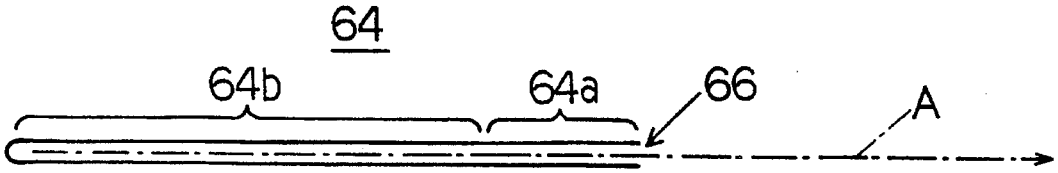
FIG. 13(b)
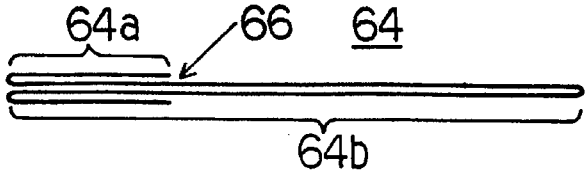

SUPPORTER FOR A HUMAN BODY AND BED EQUIPMENT USING THE SAME

BACKGROUND

The present invention relates to a supporter for a human body and a bed equipment using the same, which changes the posture of a patient lying on a bed, or helps take the patient to a bathtub or toilet. The present invention spreads a hammock between the bed and the patient lying thereon, lifts up the hammock with suspending belts, and moves the hammock in directions crossing the bed to carry the patient above a bathtub or toilet for having a bath or easing nature. After having used the bath or toilet, the patient is again taken back to the bed and laid thereon.

A bed equipment disclosed in U.S. Pat. No. 5,072,840, which is expressly incorporated herein, corresponding to Japanese Patent Laid Open No. 3-202059, suspended a patient who could not move by his or her own ability by a hammock. The hammock carried the patient to a bathtub or toilet near the bed.

The prior art bed equipment has the merit that it has an instrument for raising and supporting the upper half of the patient's body, whereby the patient may be taken to the bathtub or toilet in a comfortable posture and taken back to the bed therefrom.

However, the prior art bed equipment has large unsolved problems; that is, how the hammock is moved between the bed and the patient lying thereon, and how it is removed after the patient has been returned to the bed. Such problems exist not only in the above mentioned bed equipment proposed by the applicant, but in other existing bed equipment.

Since the problems have remained unsolved, nurses raise the patient in their arms when the hammock is laid on the bed or removed therefrom. However, this work is very hard, and when changing the clothes of the patient lying on the bed, the nurse lifts the patient from the bed. This is heavy labor. In addition, as the patient usually lies on his or her back (facing upward), the patient often has to change position. The nurse permits the patient lie on his side, massaged the patient's back or lets the patient watch television. Changing the patient's position was also hard work.

OBJECTS AND SUMMARY OF THE INVENTION

It is a first object of the present invention to provide a supporter for a human body which can easily change the position of a patient lying on a bed.

It is a second object of this invention to provide a bed equipment which can easily spread a hammock between the bed and the patient thereon, and can easily remove it therefrom.

Referring to FIGS. 1 and 2, the present invention includes a supporter 31 for a human body with sleeves 34, arms 32 to be inserted between front end portions 34*b* of the sleeves 34 and base end portions 34*a* formed by inwardly bending the front end portions 34*b*, and belts 33 to be inserted into the sleeves 34.

Referring to FIGS. 5 and 6, this invention also includes bed equipment made of suspending strings 19A, 19B, 19C, 19D to be furnished at both ends of the belts 33, and motors MA2, MB2, MC2, and MD2 along with drums 11A to 11D for coiling up the suspending strings 19A–19D. The invention further includes a motor M1, rollers 4, and guide rails 5A and 5B for horizontally moving the hammock 20 in directions transverse with a bed 10.

In the above structure, the arm 32 serves as an assistant means for interposing the belt 33 under the patient, inserting the supporter 31 between the bed 10 and the patient lying thereon, and coiling up the suspending strings 19A, 19B, 19C, and 19D so as to raise the patient from the bed 10, and the hammock 20 can be easily spread on the bed 10. If the patient is similarly lifted therefrom, the hammock 20 can be easily removed from the bed 10.

If the belts 33 are moved upwardly on one side by coiling up the suspending strings 19B and 19D, the patient lying on his back can be repositioned to lie on his side. After the patient's posture is changed to the side, the nurse can easily change his clothes and massage his back, and he can watch television 51 while lying on his side.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 1(*a*) is an enlarged view of a sleeve in the embodiment of FIG. 1.

FIG. 2(*a*) is a cross sectional view of the supporter for a human body in one embodiment of the invention.

FIG. 2(*b*) is a cross sectional view of the supporter for a human body in one embodiment of the invention.

FIG. 2(*c*) is a cross sectional view of the supporter for a human body in one embodiment of the invention.

FIG. 2(*d*) is an enlarged view of a sleeve of the supporter shown in FIG. 2(*b*).

FIG. 3(*b*) is a cross sectional view of the supporter for a human body in use in one embodiment of the invention.

FIG. 3(*c*) is a cross sectional view of the supporter for a human body in use in one embodiment of the invention.

FIG. 3(*d*) is a cross sectional view of the supporter for a human body in use in one embodiment of the invention.

FIG. 3(*e*) is a cross sectional view of the supporter for a human body in use in one embodiment of the invention.

FIG. 3(*f*) is a cross sectional view of the supporter for a human body in use in one embodiment of the invention.

FIG. 3(*g*) is an enlarged view of a sleeve of the supporter shown in FIG. 3(*b*).

FIG. 4(*a*) is a cross sectional view of the supporter for a human body in use in one embodiment of the invention.

FIG. 4(*b*) is a cross sectional view of the supporter for a human body in use in one embodiment of the invention.

FIG. 4(*c*) is a cross sectional view of the supporter for a human body in use in one embodiment of the invention.

FIG. 4(*d*) is a cross sectional view of the supporter for a human body in use in one embodiment of the invention.

FIG. 4(*e*) is a cross sectional view of the supporter for a human body in use in one embodiment of the invention.

FIG. 4(*f*) is an enlarged view of a sleeve of the supporter shown in FIG. 4(*d*).

FIG. 8(*b*) is a front view of the bed equipment in use in one embodiment of the invention.

FIG. 8(*c*) is a front view of the bed equipment in use in one embodiment of the invention.

FIG. 12 is it perspective view of the supporter for a human body in another embodiment of the invention.

FIG. 13(*a*) is a cross sectional view of the sleeve in another embodiment of the invention.

FIG. 13(*b*) is a cross sectional view of the sleeve in another embodiment the invention.

FIG. 14(*b*) is a front view of the supporter for a human body in use in another embodiment of the invention.

FIG. 14(*c*) is a front view of the supporter for a human body in use in another embodiment of the invention.

DETAILED DESCRIPTION OF THE PREFERRED EMBODIMENT(S)

Figures 1, 1A:
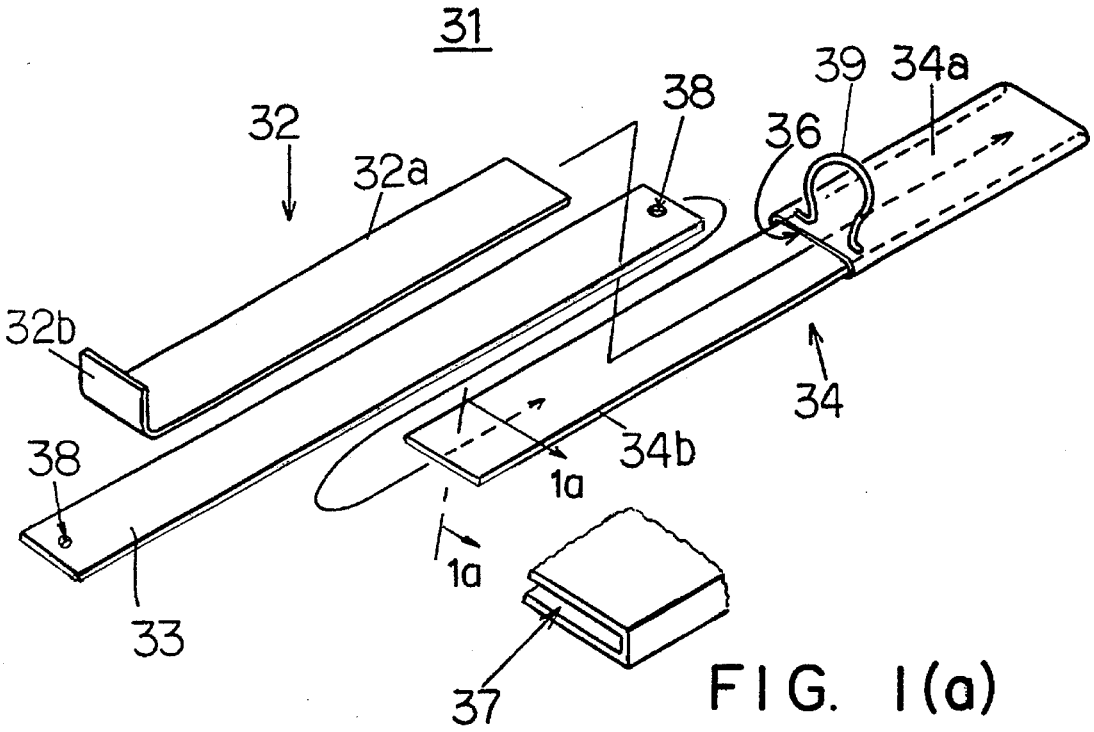
FIG. 1 is a perspective view of the supporter for a human body in one embodiment of the present invention.
Figure 3A:
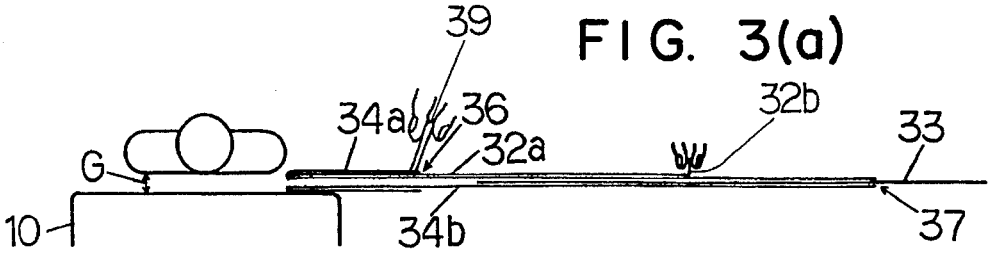
FIG. 3(*a*) is a cross sectional view of the supporter for a human body in use in one embodiment of the invention.
Figure 3B:
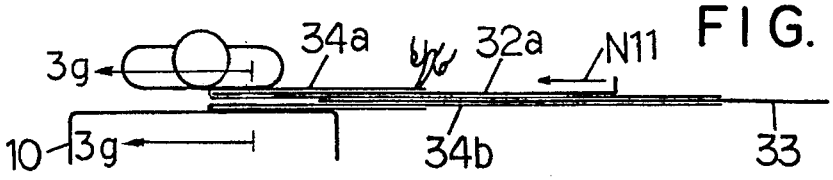
Figure 3G:
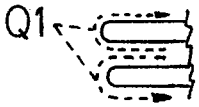
Figure 3C:
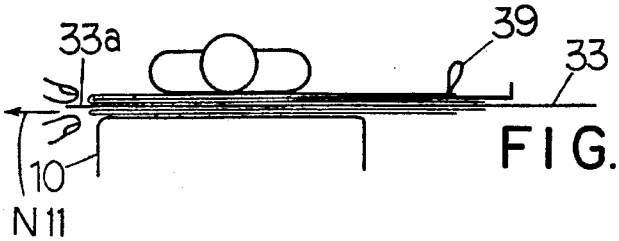
Figure 3D:
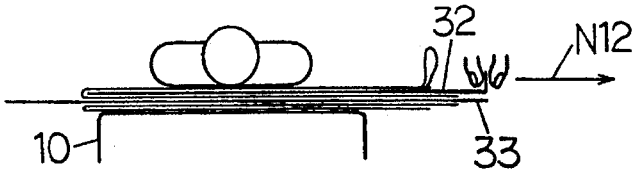
Figure 3E:
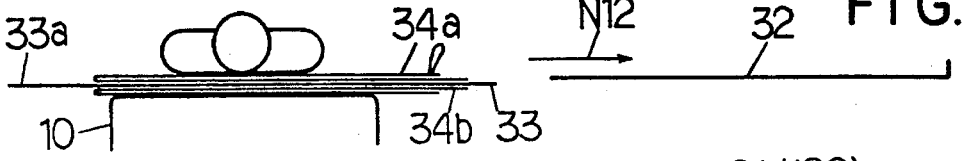
Figure 3F:
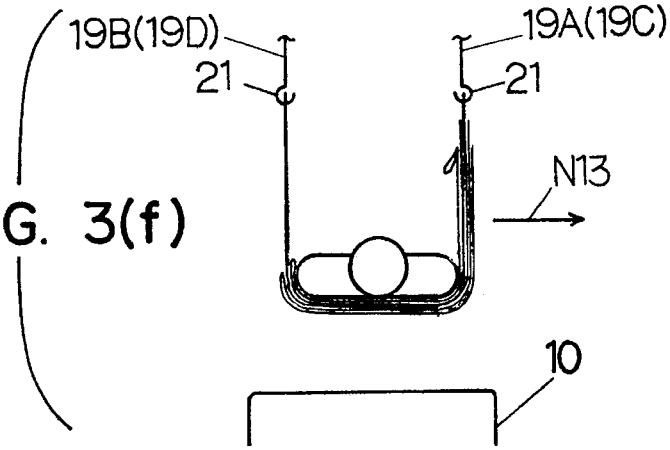

Referring to FIGS. 1, 2(*a*)–2(*c*), 3(*a*)–3(*f*) and 4(*a*)–4(*e*), supporter 31 for a human body includes an arm 32, a belt 33 and a sleeve 34. The arm 32 is formed by bending the end leaving an arm horizontal portion 32*a* and an arm end portion 32*b* to be held by fingers. The arm 32 is made of a material having elasticity and strength such as a metal plate. The belt 33 is a synthetic resin or a cloth. Holes 38 are located at both ends of belt 33. Holes 38 are engaged by hooks 21 in the lower ends of suspending strings 19A–19D. The sleeve 34 is fabricated from a material of high strength and low coefficient of friction such as Nylon. The sleeve 34 is furnished with a handle 39 on a sleeve base end portion 34*a* along with an opening 36 therein. The sleeve front end portion 34*b* has an opening 37 therein. The arm 32, belt 33 and sleeve 34 are preferably made of a water repellent material to avoid becoming waterlogged when immersed in a bathtub.

Referring to FIG. 2(*a*), openings 36 and 37 are located at both ends of the sleeve 34.

Referring to FIG. 2(*b*), the sleeve front end portion 34*b* is first folded back inwardly over the sleeve base end portion 34*a*. An arrow mark A shows a folding back direction (also refer to the enlarged part of FIG. 2(*b*)).

Referring to FIG. 2(*c*), the sleeve front end portion 34*b* is further folded back inwardly, and drawn out leftward from the opening 36 of the sleeve base end portion 34*a*. As will be explained later when referring to FIGS. 3(*a*)–3(*f*) and 4(*a*)–3(*e*), the handle 39 is held by the hand, and the arm 32 is inserted between the sleeve base end portion 34*a* and the sleeve front end portion 34*b* through the opening 36 as shown with arrow B, and the belt 33 is inserted into the inside of the sleeve front end portion 34*b* through the opening 37 as shown with arrow C.

Referring to FIG. 3(*a*), the arm end portion 32*b* is held with one hand, while the handle 39 is held with the other hand. The arm horizontal portion 32*a* is inserted through the opening 36 between the sleeve front end portion 34*b* and the sleeve base end portion 34*a* formed by turning back the sleeve front end portion 34*b* inwardly.

Referring now also to FIG. 2(*c*), the belt 33 is then inserted inside the sleeve front end portion 34*b* from the opening 37. The patient is illustrated as being above the upper surface of the bed 10 by a gap G for ease of explanation; however, actually he is on the bed 10.

Referring to FIG. 3(*b*), when the arm horizontal portion 32*a* is inserted in a direction N11, the belt front end 33*a* slowly moves between the bed 10 and the patient. At this time, as shown by arrow Q1 in a partially enlarged part, the sleeve 34 is gradually turned back outwardly and interposed between the bed 10 and the patient.

Referring to FIG. 3(*c*), when the belt front end 33*a* is drawn leftward from the left end of the sleeve 34, the belt front end 33*a* is held with the fingers to further pull out the belt 33 in the direction N11. In such a way, the belt 33 is inserted between the bed 10 and the patient, and the arm 32 is removed in a direction N12 as shown in FIGS. 3(*d*)–3(*e*). As seen from the above, the arm 32 assists in placing the belt 33 between the bed 10 and the patient.

As shown in FIG. 3(*f*), when the belt 33 and the sleeve 34 are positioned between the bed 10 and the body, the holes 38 in both ends of the belt 33 are engaged with hooks 21 held at the lower ends of the suspending strings 19A and 19B, or the suspending strings 19C and 19D. A motor is subsequently driven to coil up the suspending strings 19A–19D, so that the patient is raised from the bed 10 and then moved in a direction (an arrow N13) crossing the bed 10 to a bathtub or toilet.

Referring to FIGS. 4(*a*)–4(*e*), another method will be described for taking out the belt 33 and the sleeve 34 from between the bed 10 and the patient.

FIG. 4(*a*) shows, similarly to FIG. 3(*f*), that after having lifted the patient from the bed 10 to take him to the bathtub or toilet, he is again taken back above the bed 10 and moved down thereon. FIG. 4(*a*) shows the same condition as in FIG. 3(*e*).

A sleeve left end portion 341*a* is held with one hand as shown in FIG. 4(*a*), while the belt right end 33*b* is held with the other hand. If the belt 33 is pulled in a direction N14 as illustrated in FIGS. 4(*b*)–4(*c*), the belt 33 is drawn out from the sleeve 34. If a sleeve right end portion 341*b* is held with the fingers as seen in FIGS. 4(*d*)–4(*e*) and pulled in a direction N15, the sleeve 34 is gradually turned back in a direction Q2, and drawn out from the body and the bed 10 (refer to the partially enlarged diagram).

Referring also to FIGS. 3(*a*)–3(*e*), when inserting the belt 33 and the sleeve 34 between the patient and the bed 10, or taking out them therefrom as illustrated in FIGS. 4(*a*)–4(*e*), the outer surface of the sleeve 34 which is being turned back in the direction Q1 (as shown in the partially enlarged part of FIG. 3(*b*)) or in the direction Q2 (as shown in the partially enlarged part of FIG. 4(*d*)) slightly touches the patient on his back, and the procedure is accordingly painless. He strongly presses his back to the upper surface of the bed 10, and does not strongly press his waist, hip and legs thereto. It is therefore easy to insert the belt 33 under the hip or legs and take it out again.

Figure 5:
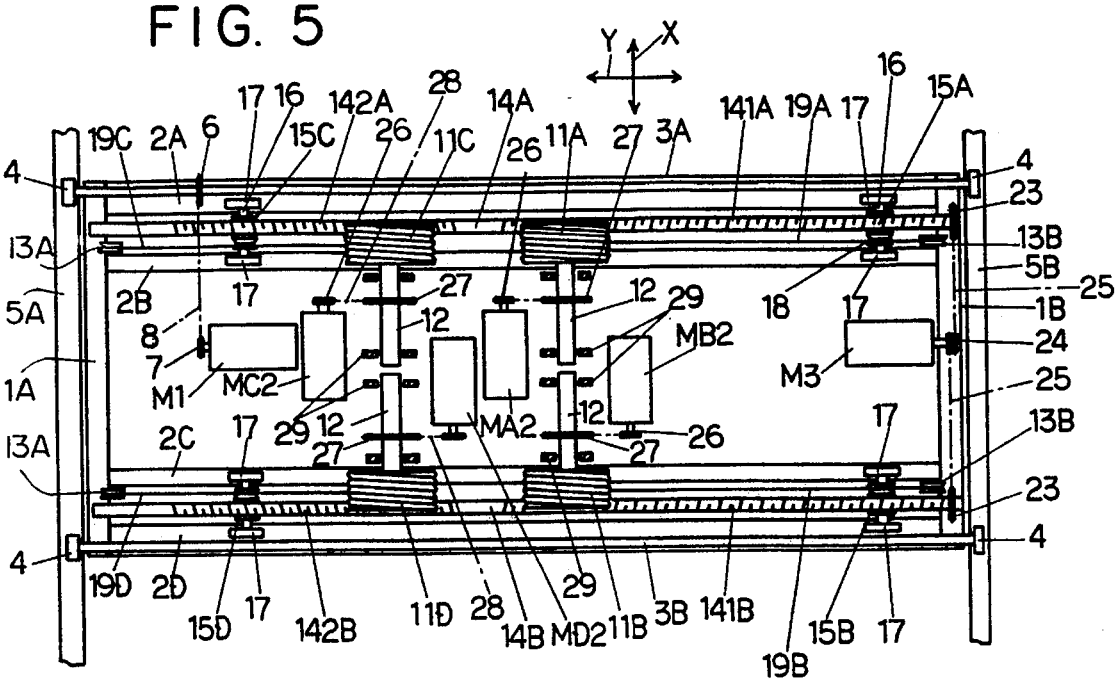
FIG. 5 is a plan view of the bed equipment in one embodiment of the invention.

Referring to FIG. 5, four parallel rails 2A, 2B, 2C, and 2D are between a left frame 1A and a right frame 1B. The frames 1A and 1B are mounted thereon with rotation shafts 3A and 3B which are provided with rollers 4 moving on guide rails 5A and 5B which are outside of the frames 1A and 1B. In the following explanation, the direction parallel to the length of the guide rails 5A and 5B is X direction, while the direction transverse with the X direction is Y direction.

One rotation shaft 3A includes a sprocket 6. A motor M1 is disposed between the rail 2B and the rail 2C. The rotation shaft of the first motor M1 has a sprocket 7 mounted thereon. A chain 8 is reeved over sprockets 6 and 7. When the motor M1 is driven, the rotation shaft 3A and the roller 4 rotate on the guide rails 5A and 5B, and the frames 1A and 1B move in the direction X along the guide rails 5A and 5B. Rotation shafts 3A and 3B are connected, and the rotation shaft 3A is rotated by the motor M1. When the rollers 4 at both ends of the rotation shaft 3A rotate on the guide rails 5A and 5B in direction X, the rollers 4 at both ends of guide rail 5B also rotate on the guide rails 5A and 5B in the direction X. In other words, the motor M1, rollers 4 and guide rails 5A and 5B serve as crossing instruments for moving the hammock 20 carrying the patient in the direction transverse to the bed 10 (the direction X).

Figure 6:
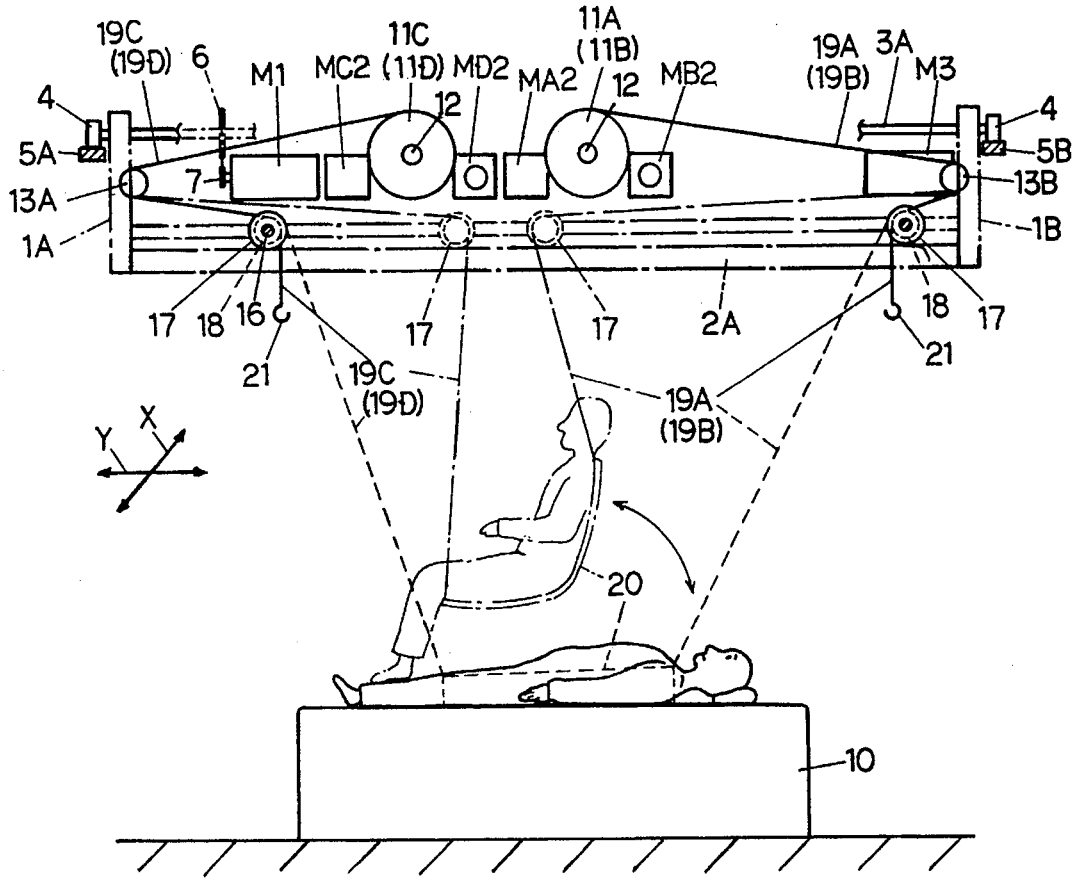
FIG. 6 is a plan view of the bed equipment in one embodiment of the invention.

Referring now also to FIG. 6, four drums 11A, 11B, 11C, and 11D are located between the frames 1A and 1B. The drums 11A, 11B have the suspending strings 19A and 19B coiled thereon. The drums 11C and 11D have suspending strings 19C and 19D coiled thereon. Each of the drums 11A–11D has a rotation shaft 12 carried by bearings 29. The drum 11A is rotated by a motor MA2 via sprockets 26 and 27 and a chain 28. Similarly the other drums 11B, 11C, 11D are driven by the motors MB2, MC2, and MD2 via sprockets 26 and 27 and a chain 28, respectively.

Inside of the left frame 1A, fixed pulleys 13A are provided. Inside of the right frame 1B, fixed pulleys 13B are provided. These fixed pulleys 13A and 13B are secured to the frames 1A and 1B via bearings which are not shown. A first feed screw 14A is furnished between the rails 2A and 2B, and a second feed screw 14B is furnished between the rails 2C and 2D. The first feed screw 14A is defined on the right side with a rightward screwthread 141A on which a right nut 15A is screwed, while the first feed screw 14A is defined on the left side with a leftward screwthread 142A on which a left nut 15C is screwed. The second feed screw 14B is also defined with a rightward screw-thread 141B and a leftward screwthread 142B which are respectively screwed with a right nut 15B and a left nut 15D.

Pitches of the rightward screwthreads 141A and 141B are larger than those of the leftward screwthreads 142A and 142B. Each of the nuts 15A–15D is provided with a rotation shaft 16 which is provided with a roller 17 and a movable pulley 18. The rollers 17 are carried on the rails 2A, 2B, 2C and 2D. The suspending strings 19A and 19B mounted on the drums 11A and 11B are associated with the fixed pulley 13B and the movable pulley 18. The suspending strings 19A and 19B have hooks 21 at the lower ends for holding the right end portions (the part near the patient's head) of the hammock 20. On the other hand, the suspending strings 19C and 19D mounted on the drums 11C and 11D are also associated with the fixed pulley 13A and the movable pulley 18, and the suspending strings 19C and 19D have hooks 21 at the lower ends for holding the left end portions (the part near the patient's legs) of the hammock 20. The hammock 20 is preferably formed as a net of water repellent material so as to avoid being impregnated by the water when immersed in a bath.

A motor M3 is located between the first feed screw 14A and the second feed screw 14B. Sprockets 23 are furnished on the right ends of the first and second feed screws 14A and 14B. A sprocket 24 is mounted on the rotation shaft of the motor M3, and a chain 25 is reeved over sprockets 23 and 24. Accordingly, when the motor M3 is driven, the feed screws 14A and 14B rotate synchronously. When the feed screws 14A and 14B rotate, the nuts 15D–15D move in the direction Y along the feed screws 14A and 14B.

The rightward screwthreads 141A and 141B and the leftward screwthreads 142A and 142B are threaded in opposition respectively. In such a way, if the motor M3 normally rotates, the right nuts 15A and 15B on the right side move leftward, and the left nuts 15C and 15D on the left side move rightward, and vice versa. Then, the movable pulleys 18 integrally attached to the nuts 15A to 15D move in the same direction as the nuts 15A to 15D. Since the pitches of the right screwthreads 141A and 141B are larger than those of the left screwthreads 142A and 142B, the right nuts 15A and 15B move faster in the direction Y than the left nuts 15C and 15D.

The suspending strings 19A and 19B and the suspending strings 19C and 19D lift the hammock 20 as shown with the dotted line. The motor M3 normally rotates, so that the right nuts 15A and 15B and the left nuts 15C and 15D approach each other. With respect to the suspending strings 19A and 19B and the suspending strings 19C and 19D as shown with the dotted line, the motor M3 rotates in reverse, so that the right nuts 15A and 15B and the left nuts 15C and 15D move apart. That is, the feed screws 14A and 14B, the nuts 15A to 15D, and the motor M3 bring together or separate the suspending strings 19A and 19B and the suspending strings 19C and 19D.

The bringing together or separating raise or lower the upper half of the patient on the hammock 20. For raising the patient lying on the bed through the hammock 20, the suspending strings 19A and 19B and the suspending strings 19C and 19D are gradually brought together, thereby raising his upper hall For lowering him in the hammock onto the bed 10, the suspending strings 19A and 19B and the suspending strings 19C and 19D are gradually separated, thereby lowering his upper half.

Further, the suspending strings 19A and 19B and the suspending strings 19C and 19D can be independently coiled up or uncoiled down by driving motors MA2, MB2, MC2 and MD2. If normally rotating the motors MA2, MB2, MC2, and MD2, thereby normally rotating drums 11A, 11B, 11C, and 11D, the suspending strings 19A, 19B, 19C, 19D uncoil from the drums 11A–11D and the hooks lower. On the other hand, rotating in reverse the motors MA2, MB2, MC2, and MD2, thereby reversely rotating the drums 11A, 11B, 11C, and 11D, the suspending strings 19A, 19B, 19C, and 19D are coiled on the drums 11A to 11D and the hooks rise.

Figure 7:
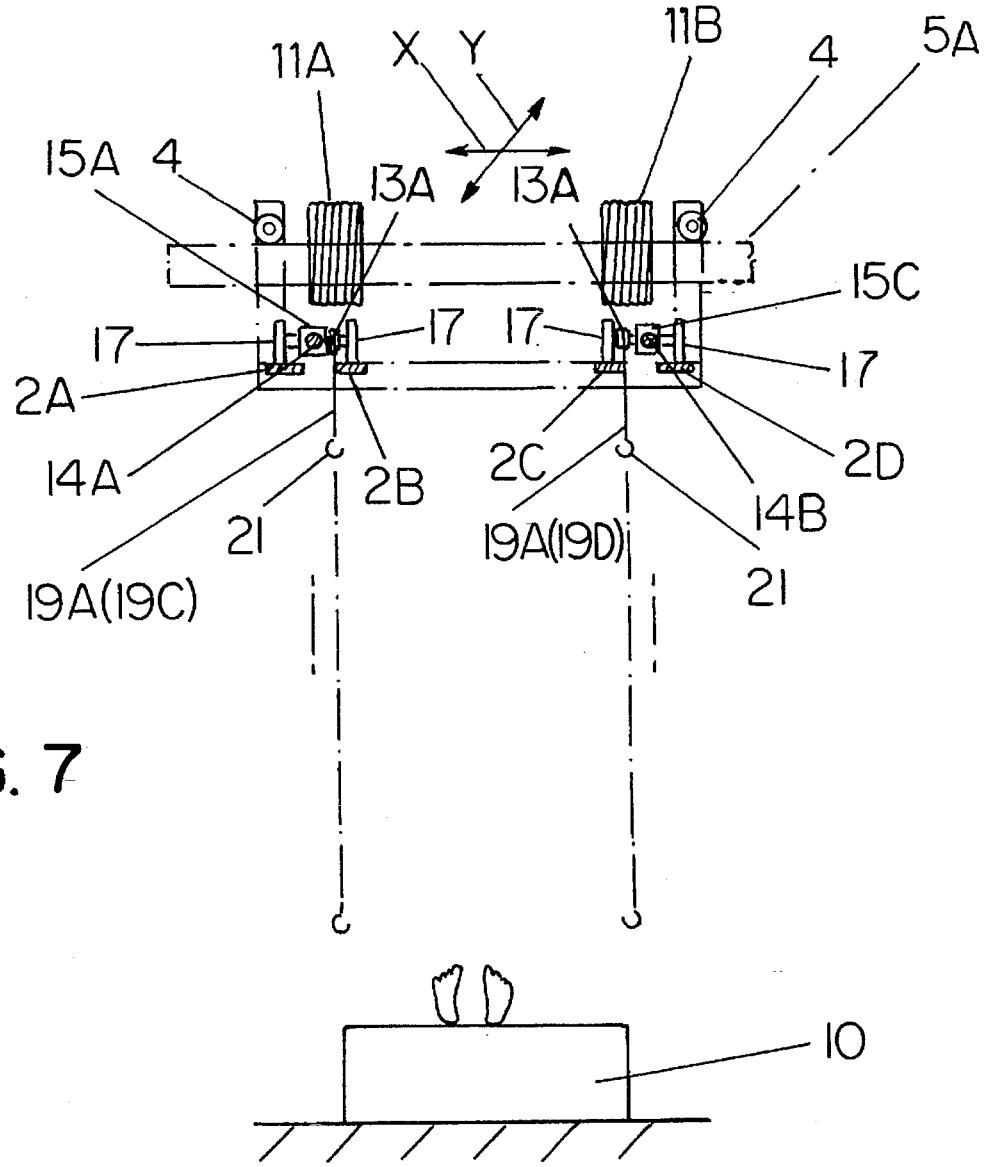
FIG. 7 is a plan view of the bed equipment in one embodiment of the invention.

Referring to FIGS. 6 and 7, when the bed equipment is not in use, the suspending strings 19A to 19D are coiled up as shown in the solid line so that the hooks are at the high position.

Figures 8A, 8B, 8C:
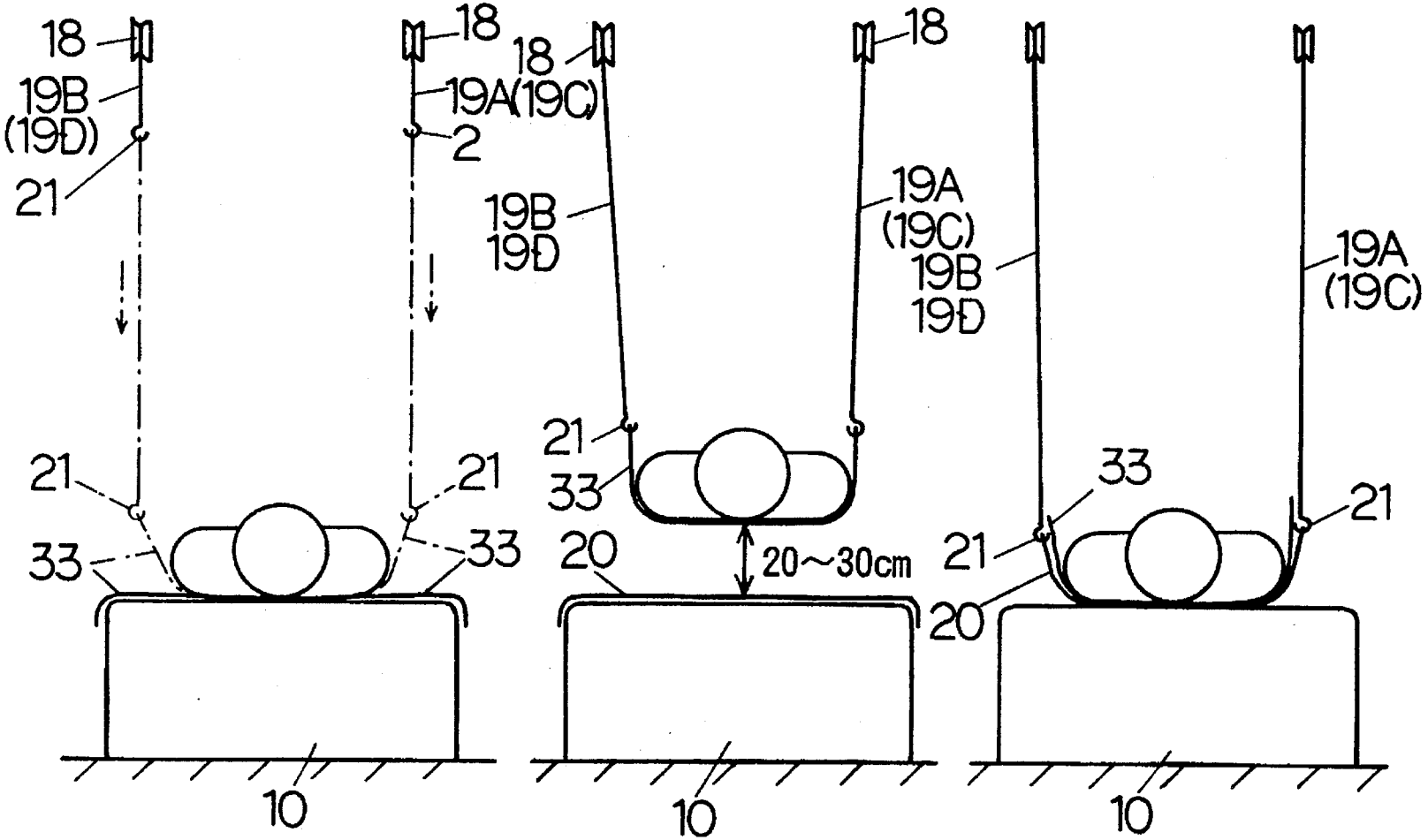
FIG. 8(*a*) is a front view of the bed equipment in use in one embodiment of the invention.

Referring now also to FIG. 8(*a*), the motors MA2, MB2, MC2, and MD2 are normally rotated to draw out all the suspending strings 19A to 19D coiled on the drums 11A to 11D to move down the hooks 21 from the position shown with the solid line to the position shown with the broken line. Next, the belt 33 and the sleeve 34 are interposed between the bed 10 and the patient as previously explained. When the belt 33 and the sleeve 34 have been placed, the hooks 21 are engaged by the holes 38 in both ends of the belt 33 (see the broken line in FIG. 8(*a*)). Two belts 33 are used; one for the upper portion of the body and one for the lower portion. The belt 33 for the upper portion is engaged at both ends with the hooks 21 of the suspending strings 19A and 19B, and the belt 33 for the lower portion is engaged at both ends with the hooks 21 of the suspending strings 19C and 19D (also see FIG. 6).

Referring to FIG. 8(*b*), the motors MA2 to MD2 are rotated reversely to move up the hooks 21 so that the patient is lifted up around 20 to 30 cm. With the patient supported, the hammock 20 can be easily spread on the bed 10.

Referring to FIG. 8(*c*), if the motors MA2 to MD2 are normally rotated, the hooks 21 are moved down to lower the patient onto the bed 10, and all the hooks 21 are removed from the belts 33 and thereafter the hooks 21 are engaged with the hammock 20 at the four corners. Thus the hammock 20 is spread between the bed 10 and the patient.

Figure 9:
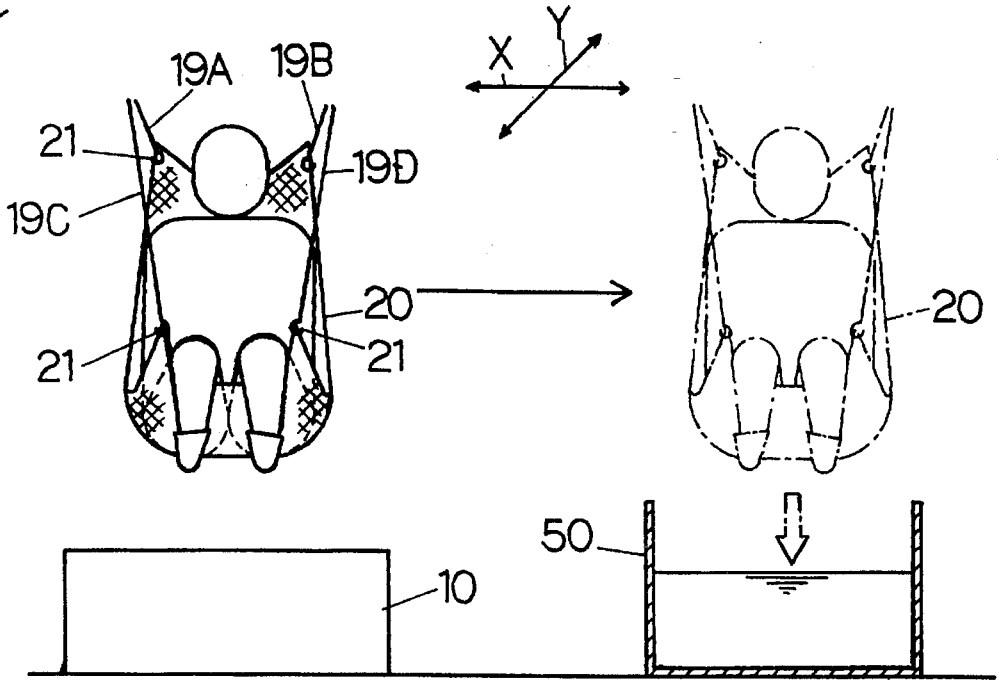
FIG. 9 is a front view of the bed equipment in use in one embodiment of the invention.

The next explanation concerns the method of taking the patient to a bathtub near the bed 10 with the hammock 20. FIG. 6 shows with the dashed line where the hammock 20 is laid under the patient lying on the bed 10 as seen in FIG. 8(*c*). Then, motor M3 (FIG. 5) is driven causing the suspending strings 19A and 19B to approach suspending strings 19C and 19D, and at the same time, the motors MA2–MD2 are driven to rotate the drums 11A to 11D, thus coiling up all the suspending strings 19A to 19D. The patient is lifted from the bed 10 while raising his upper half as shown with the broken line in FIG. 6. FIG. 9 shows with the solid line the front view of the patient lifted from the bed 10 in such a manner.

Subsequently, if the motor M1 (see FIG. 5) is driven, the rollers 4 move on the guide rails 5A and 5B in the direction transverse with the bed 10 (direction X), so that the patient is moved above the bathtub 50 (shown by the broken line in FIG. 9). The motors MA2 to MD2 are normally rotated to move down the hammock 20 and take him into the bathtub 50. The motor M3 is then stopped, so that the distances between the right nuts 15A and 15B and the nuts 15C and 15D, i.e., the distances between the suspending strings 19A and 19B and the suspending strings 19C and 19D are fixed. The patient is lowered into the bathtub 50 with his upper portion raised as seen in FIG. 9. For bathing his body, the hooks 21 are taken off the hammock 20, and the hammock 20 is removed from the bathtub 50.

Figure 10:
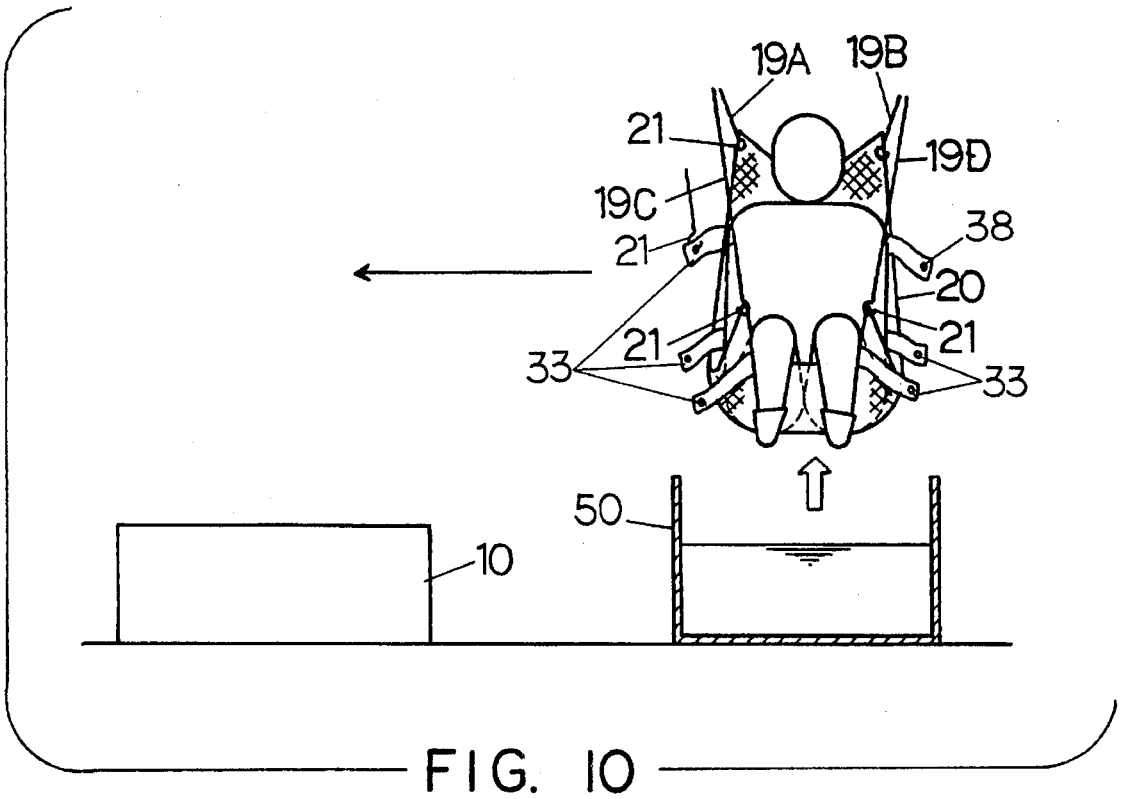
FIG. 10 is a front view of the bed equipment in use in one embodiment of the invention.

After the bath, the belts 33 are placed under his body in the bathtub 50. The belts 33 are inserted in the sleeves 34 with both ends of the belts 33 drawn out from the sleeves 34. Next, the hammock 20 is put under the belts 33, and the hooks 21 are set in the hammock 20. The arms 32 are not required at this time. The motors MA2 to MD2 are rotated in reverse to raise the hammock 20 and lift the patient from the bathtub 50. FIG. 10 illustrates this condition. The nurse wipes him with a towel. The belt 33 and the sleeve 34 are water repellent, and since the hammock 20 is net, little water is absorbed.

The motor M1 is rotated in reverse to move the rollers on the guide rails 5A and 5B which carry the patient above the bed 10. The condition at this time is the same as shown with the broken line in FIG. 6. The motors MA2 to MD2 are driven to lower the patient. If rotating the motor M3 in reverse to the above position, the movable pulleys 18 move from the position shown in the broken line in FIG. 6 to the position shown with the solid line. Since the suspending strings 19A and 19B and the suspending strings 19C and 19D separate from each other, the patient's upper half moves backward, so that he may lay on the bed 10 with ease as shown by the solid line in FIG. 6. The state at this time is the same as shown in FIG. 8(*c*). All the hooks 21 are removed from the hammock 20, and are thereafter set into the holes 38 in both ends of the belts 33.

The motors MA2 to MD2 are driven to lift the patient from the bed 10 by the belts 33. This state is the same as shown in FIG. 8(*b*). The hammock 20 is then removed from the bed 10.

The motors MA2 to MD2 are driven to again move the patient onto the bed 10. This state is the same as shown in FIG. 8(*a*). All the hooks 21 are removed from the belts 33. The belts 33 and the sleeve 34 are then removed from the bed 10 and the patient. This removing method is the same as already described with FIG. 4. In this way, the bathing is finished. The work of taking the patient to the toilet for easing nature is basically the same as taking the bath, and an explanation therefor is omitted.

Figures 11A, 11B:
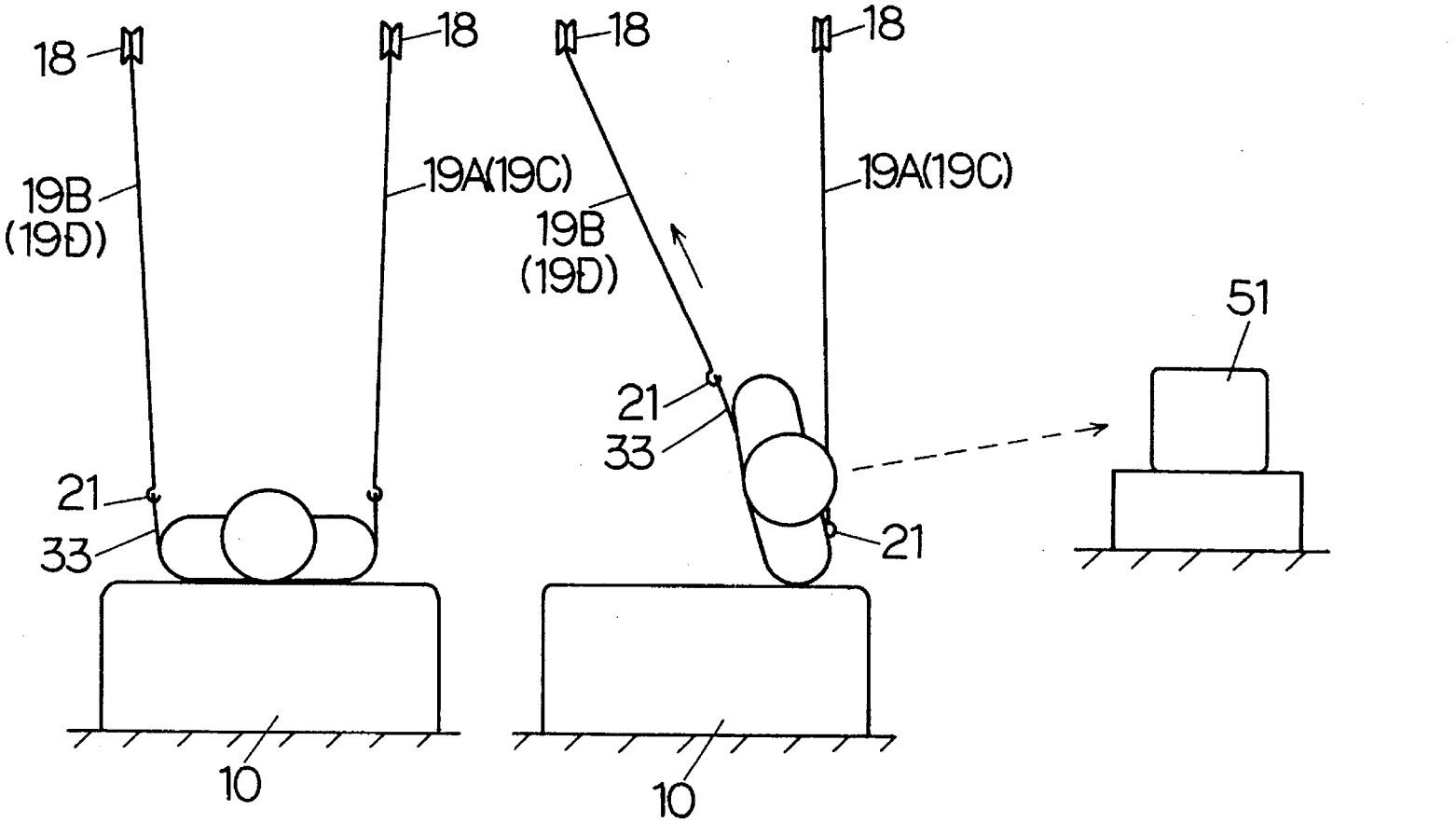
FIG. 11 is a front view of the bed equipment in use in one embodiment of the invention.

Referring to FIGS. 11(*a*)–(*b*), another method of using the supporter 31 will be described.

Referring to FIG. 11(*a*), the belt 33 is inserted between the bed 10 and the patient. This condition is the same as shown with the broken line in FIG. 8(*a*). If the motors MB2 and MD2 (FIG. 5) on one side are driven to lift up only the strings 19B and 19D, the patient is made to lie on his side as seen in FIG. 11(*b*), so that he can watch the television 51 placed by the bed 10. In such a position, the nurse can massage his back, and his clothes can be changed easily. If the motors are rotated in reverse, the patient lies on his back as seen in FIG. 11(*a*). This supporter is used in various ways as set forth above.

Referring to FIG. 12, another embodiment of the supporter 61 includes arms 62 and sleeves 64. The arm 62 is in an "L" shape having a horizontal part 62*a* and a bent part 62*b*. The horizontal part 62*a* contains a hole 63 at its front end for engagement by a hook 21. The sleeve 64 is turned inwardly back at the front end part 64*b* which is opened with a hole 65 for inserting the hook 21.

Referring to FIG. 13(*a*), a cross sectional view of the sleeve 64 is shown before it is turned back.

Referring to FIG. 13(*b*), turning back the front end part 64*b* inwardly as shown with the broken line A causes front end part 64*b* to project from an opening 66 of a base end part 64*a*. Arm 62 is inserted at the front end portion between the base end part 64*a* and the front end part 64*b* from the opening 66.

Figure 14A:
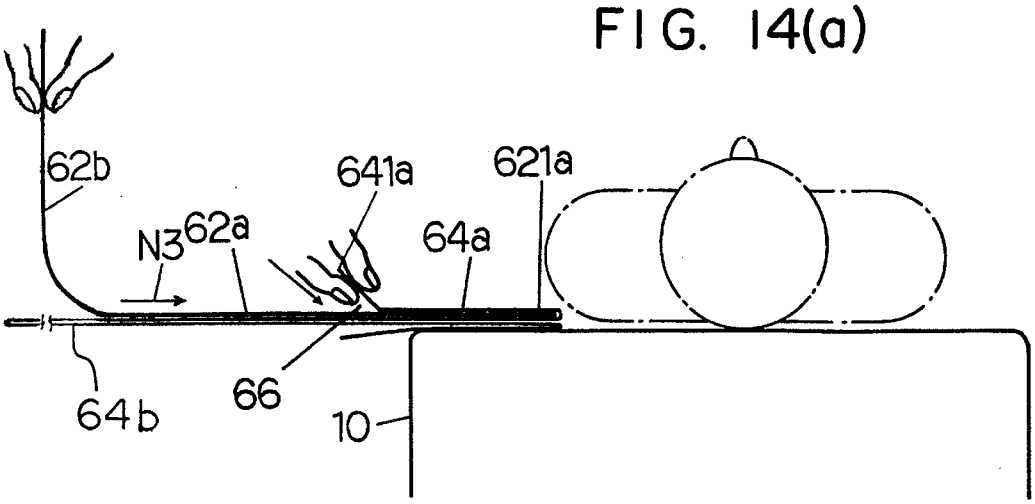
FIG. 14(*a*) is a front view of the supporter for a human body in use in another embodiment of the invention.
Figure 14B:
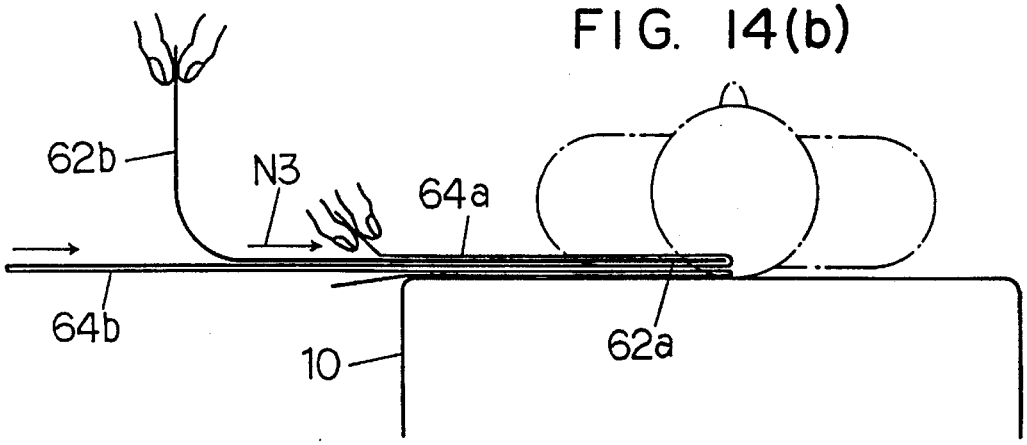
Figure 14C:
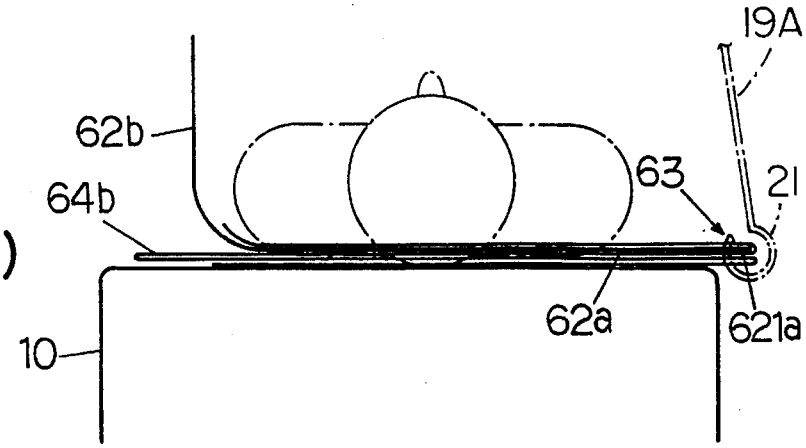

Referring to FIG. 14(*a*), the base end part 64*a* is held at an end 641*a* with the fingers of one hand and the arm 62 is held at the bent part 62*b* with the fingers of the other hand, and the horizontal part 62*a* is inserted at the end part 621*a* between the base end part 64*a* and the front end part 64*b* (see direction arrow N3).

Figure 15:
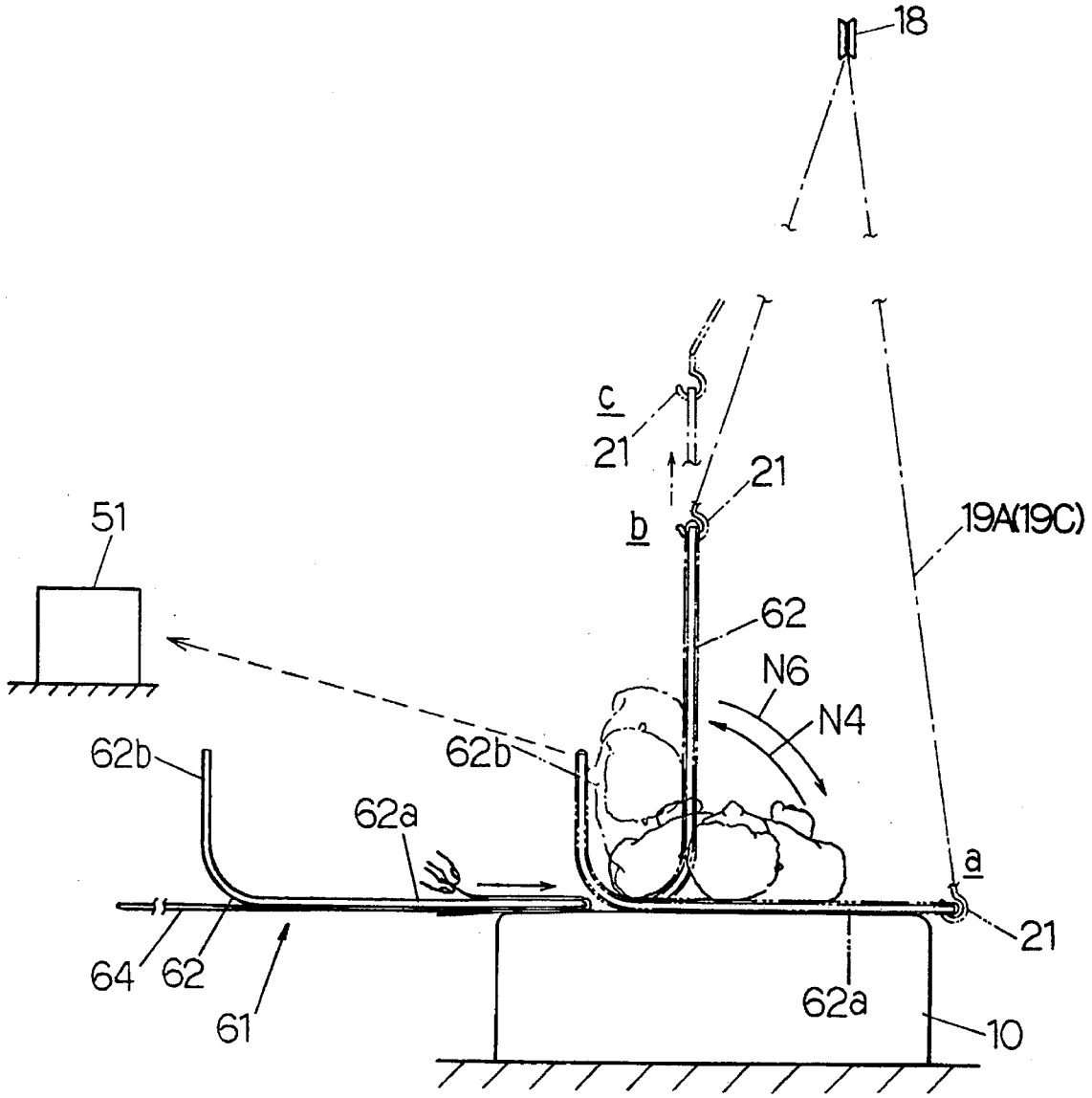
FIG. 15 is a front view of the bed equipment in another embodiment of the invention.

Referring to FIG. 15 illustrates the arm 62 shown with the solid line in this condition. The horizontal part 62*a* is further inserted in the direction N3 between the body and the bed 10, so that the front end portion 621*a* of the horizontal part 62*a* is projected toward the right side of the body. The hook 21 is inserted into the hole 63 formed in the horizontal part 62*a* and the hole 65 formed in the front end part 64*b*. The broken line of FIG. 15 shows the same condition as FIG. 14(*c*).

When the motors MA2 and MC2 are driven to coil the suspending strings 19A and 19C on the drums 11A and 11C, the hook 21 is lifted up from a position a to a position b. The body of the patient is turned 90° in the direction shown by arrow N4. If the patient's posture is changed from the supine to sideways, the nurse can touch his back or change his clothes. In addition, the patient can watch television 51 or take a meal from his sideways position.

Figure 16:
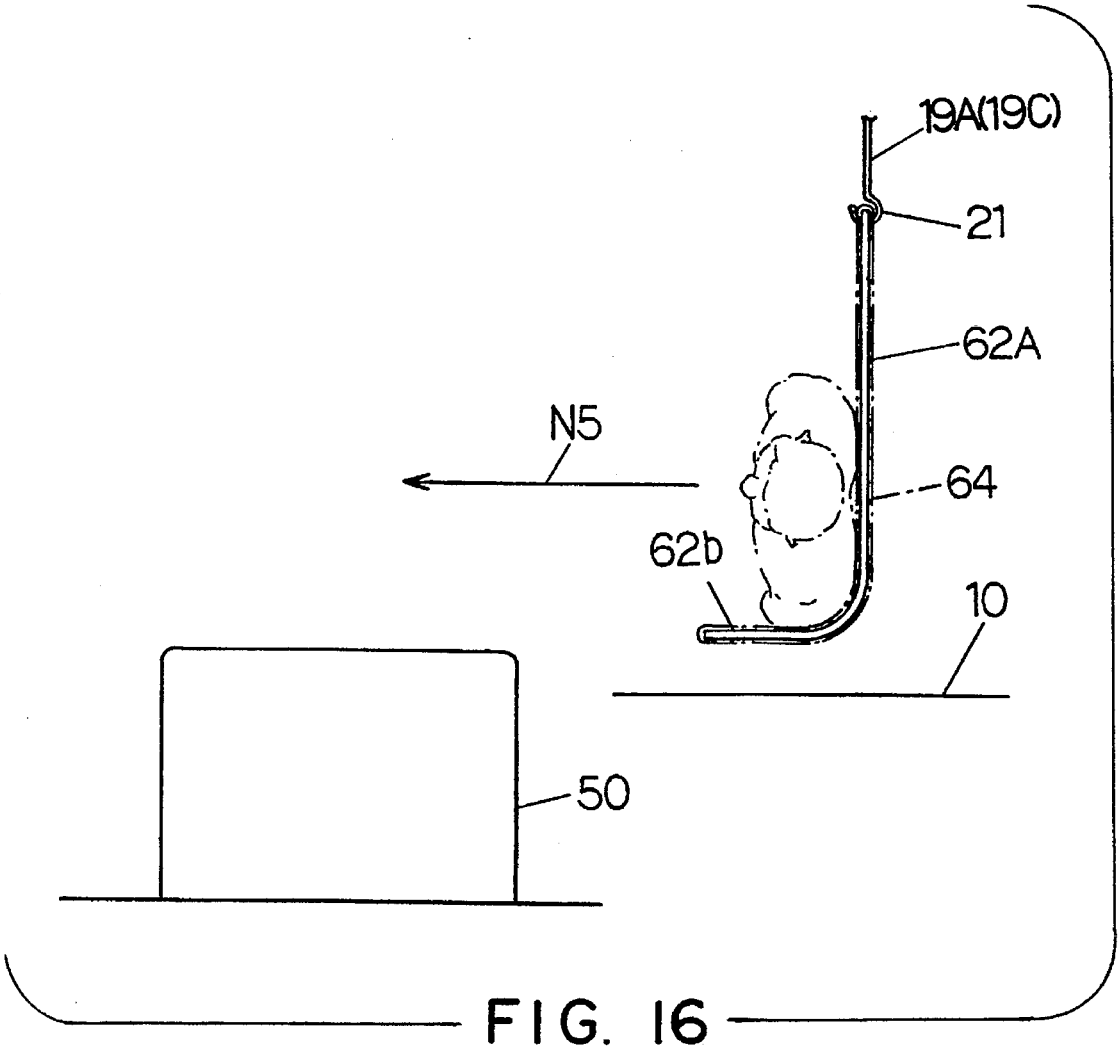
FIG. 16 is a front view of the supporter for a human body in use in another embodiment of the invention.

For taking the patient to the bathtub or the toilet, the motors MA2 and MC2 are further driven to coil the suspending strings 19A and 19C on the drums 11A and 11C, so that the hook 21 is moved up to a position c and the patient is lifted off the bed 10. This state is also shown in FIG. 16. The patient is then moved horizontally in a direction N5 to the bathtub 50 or a toilet (not shown here).

For returning the lifted patient onto the bed 10, when the motors MA2 and MC2 are rotated in reverse, the hook 21 goes down from a position c to a position b, and he is lowered onto the bed 10. If the motors MA2 and MC2 are further rotated, the arm 62 is rotated in a direction N6, and the hook 21 goes down to position a, so that the patient again looks upward on the bed 10.

Figure 17:
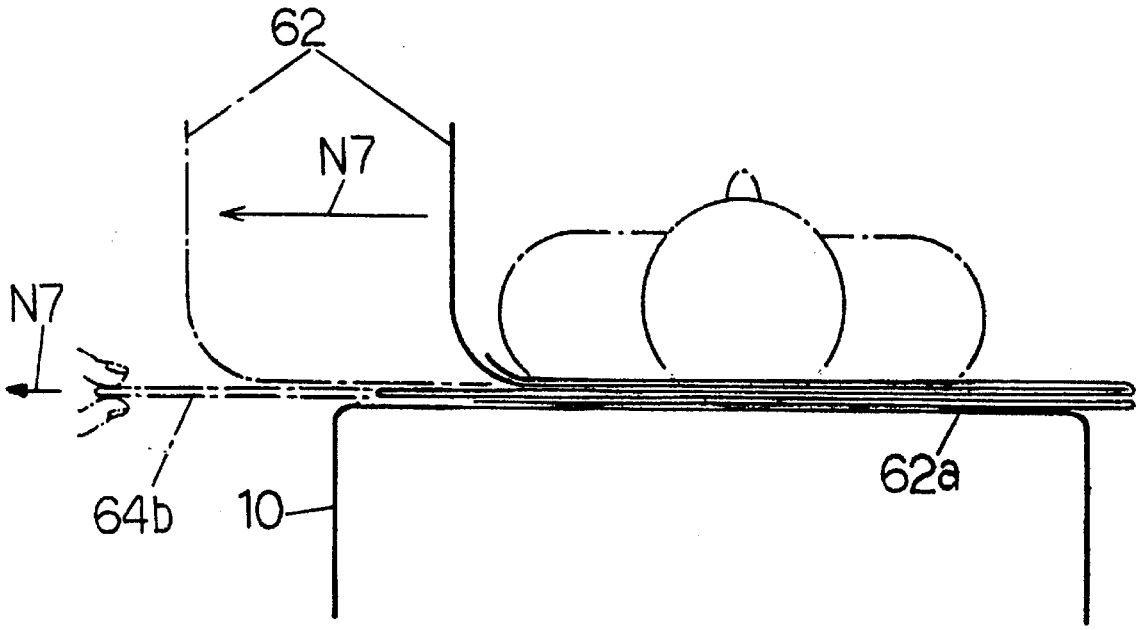
FIG. 17 is a front view of the supporter for a human body in use in another embodiment of the invention.

Referring to FIG. 17, a method of removing the arm 62 and the sleeves 64 from between the patient's back and the bed 10 is described. If the sleeve 64 is held at the front end part 64*b* with the fingers and pulled in a direction N7, the arm 62 is also moved in the same direction. The arm 62 and the sleeve 64 are removed from between the patient and the bed 10. In this case, the bent part 62*b* is held with the fingers and the arm 62 is moved in the direction N7, and the horizontal part 62*a* is removed therefrom. Then the sleeve 64 is held at the front end part 64*b* with the fingers and the sleeve 64 is removed.

Without the sleeve 64, only the arm 62 is pushed between the body and the bed 10, the horizontal part 62*a* picks at the patient's back with its front end, or the horizontal part 62*a* rubs his back, and he feels a physical pain. In particular, as a serious patient often lies unclothed on the bed 10, if an uncovered horizontal part 62*a* stripped of the sleeve 64 is pushed between the body and the bed 10, the horizontal part 62*a* touches the patient's back at its front end, thereby causing pain. If the patient is an old man, his skin is flabby, and the end of the arm 62 easily hurts him. When the horizontal part 62*a* is removed, it rubs his body if without the sleeve 64, and the patient feels a lot of pain.

For painless operation, the arm 62 is covered with the sleeve 64 and interposed with the horizontal part 62*a* between the body and the bed 10. Thus, when placing the sleeve 64 between the patient's body and the bed 10, and when interposing or removing the horizontal part 62*a*, the arm 62 covered by the sleeve 64 neither bites nor rubs his back.

Figure 18:
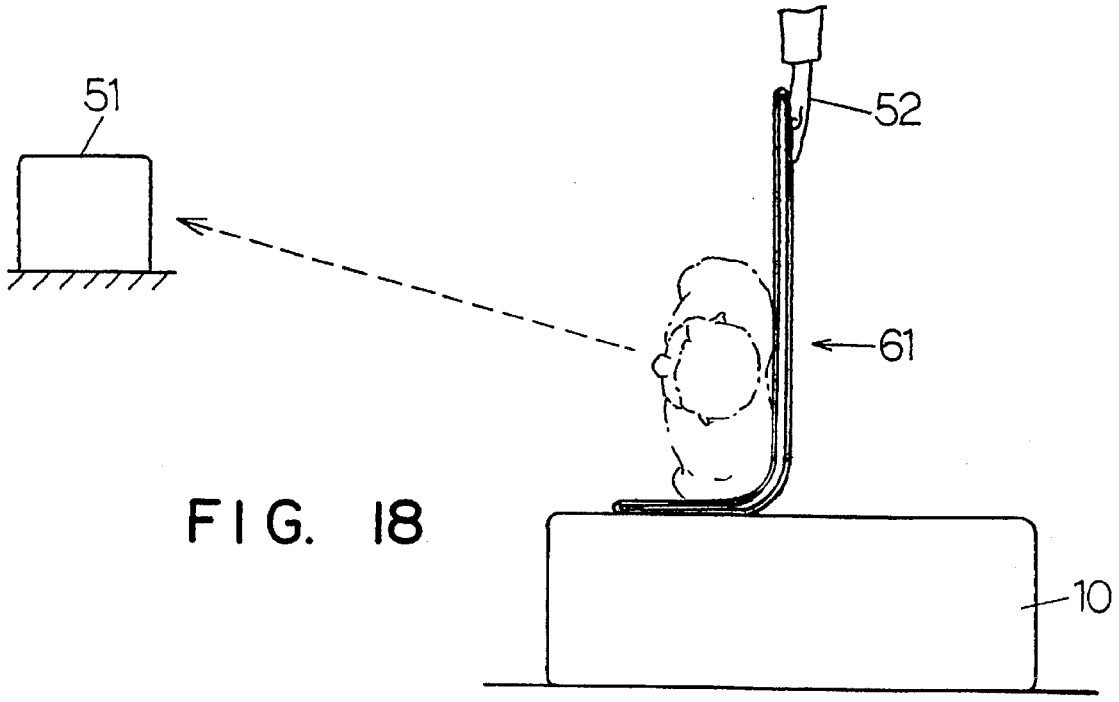
FIG. 18 is a front view of the supporter for a human body in use in another embodiment of the invention.

Referring to FIG. 18, the supporter 61 may be used by itself as a means for changing the patient's position. In this case, the hook 21 is not used, and the patient's position is changed sideways by the supporter 61. The supporter 61 is raised by the nurse's hand 52. While keeping the patient's position fixed, the nurse may massage his back or change his clothes, or let him watch television 51.

Figure 19:
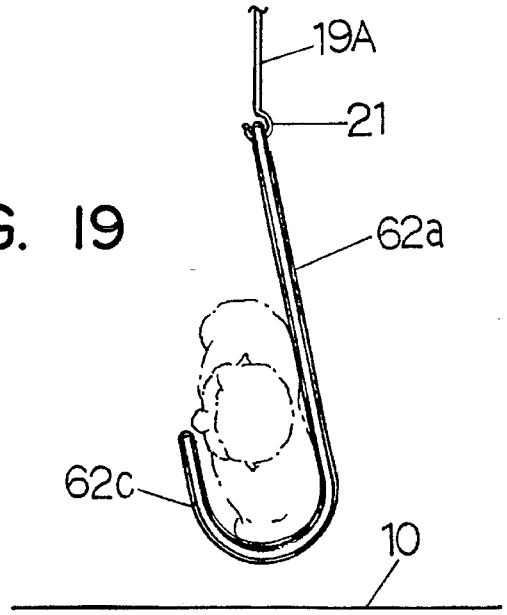
FIG. 19 is a front view of the supporter for a human body in use in another embodiment of the invention.

Referring to FIG. 19, a bent part 62*c* may be shaped in a "U", whereby the patient can be supported securely.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A supporter for a human body, comprising:

a sleeve having a sleeve front end portion and a sleeve base end portion;

said sleeve including a handle on an end of said sleeve base end portion;

an arm insertable into said sleeve; and a belt insertable into said sleeve.

2. A supporter for a human body, comprising:

a sleeve having a sleeve front end portion and a sleeve base end portion;

an arm insertable into said sleeve having a bend at one end of said arm to facilitate grasping with fingers; and a belt insertable into said sleeve.

3. A supporter for a human body comprising:

a sleeve having a sleeve front end portion and a sleeve base end portion;

an arm insertable into said sleeve;

a belt insertable into said sleeve;

first and second holes in said belt;

said first hole being at a first end of said belt and said second hole being at a second end of said belt; and said first and second holes being adapted for the engagement of hooks therewith.

4. A supporter for a human body, comprising:

a sleeve having a sleeve front end portion and a sleeve base end portion;

an arm insertable into said sleeve wherein said arm is in a "U" shape; and a belt insertable into said sleeve.

5. A method for moving a patient from a surface, comprising:

passing first and second sleeves under said patient;

lifting of said first and second sleeves to raise at least a portion of said patient above said surface;

a hammock spreadable under at least a portion of said patient raised by said first and second sleeves;

lowering said first and second sleeves to place said patient on said hammock; and raising said hammock to lift said patient from said surface.

6. The method as recited in claim 5, further comprising moving said hammock selectably in an x and a y direction.

7. A bed equipment using a supporter for a human body, comprising:

supporting means for a human body to be placed between a bed and a patient lying thereon, said supporting means including a first and second sleeve each having a sleeve front end portion and a sleeve base end portion, arms insertable into said first and second sleeves, and belts insertable into said first and second sleeves;

a plurality of suspending strings to be attached to said supporting means;

means for attaching said suspending strings to said supporting means;

lifting means for raising or lowering said suspending strings; and said lifting means operating independently of one another, with a separate lifting means for each suspending string.

8. The bed equipment as recited in claim 7, further comprising means for horizontally moving said supporting means in directions transverse with said bed.

9. The bed equipment as recited in claim 7, further comprising means for horizontally moving said supporting means in directions longitudinal with said bed.

10. The bed equipment as recited in claim 7, further comprising means for moving said suspending strings near a head area of said human body relative to said suspending strings near a leg area of said human body.

11. The bed equipment as recited in claim 7, further comprising means for moving said suspending strings near a first side of said human body relative to said suspending strings near a second side of said human body.

12. The bed equipment as recited in claim 11, further comprising means for moving said suspending strings near a head area of said human body relative to said suspending strings near a leg area of said human body.

* * * * *